US006446375B1

(12) United States Patent
Davis

(10) Patent No.: US 6,446,375 B1
(45) Date of Patent: Sep. 10, 2002

(54) AUTOMOBILE WINDOW MESSAGE DISPLAY DEVICE

(76) Inventor: Michael C. Davis, 102 Solace Ct., Encinitas, CA (US) 92024

( * ) Notice: Subject to any disclaimer, the term of this patent is extended or adjusted under 35 U.S.C. 154(b) by 103 days.

(21) Appl. No.: 09/616,264

(22) Filed: Jul. 14, 2000

(51) Int. Cl.[7] ..... G09F 7/18

(52) U.S. Cl. ..... 40/597; 40/591; 40/611; 40/661

(58) Field of Search ..... 40/593, 597, 611, 40/643, 650, 661, 738, 766

(56) References Cited

U.S. PATENT DOCUMENTS

| | | | | | |
|---|---|---|---|---|---|
| 874,998 | A | | 12/1907 | Schumacher | 40/593 |
| 1,739,801 | A | | 12/1929 | Pitts | 248/206.3 |
| 2,143,608 | A | | 1/1939 | Morris | 40/597 |
| 3,007,435 | A | | 11/1961 | Peterson | 40/597 |
| 3,237,330 | A | | 3/1966 | Dinstbir | 40/593 |
| 4,055,012 | A | | 10/1977 | Cote | 40/593 |
| 4,953,315 | A | | 9/1990 | Romaine | 40/593 |
| 4,991,328 | A | * | 2/1991 | Rousseau et al. | 40/771 X |
| 5,062,380 | A | | 11/1991 | Chestnutt | 40/597 |
| 5,131,177 | A | | 7/1992 | Sy, Jr. | 40/597 |
| D336,931 | S | * | 6/1993 | McDonald | D20/42 |
| 5,241,768 | A | * | 9/1993 | Thompson | 40/593 X |
| 5,423,140 | A | | 6/1995 | Nuspl | 40/597 |
| 5,502,912 | A | * | 4/1996 | LeBoff et al. | 40/593 X |
| 5,933,994 | A | * | 8/1999 | Misaresh | 40/661 X |
| 5,960,572 | A | * | 10/1999 | DeVito | 40/593 |
| 6,206,184 | B1 | * | 3/2001 | Goguen et al. | 206/232 |

FOREIGN PATENT DOCUMENTS

| | | | | |
|---|---|---|---|---|
| FR | 469487 | * | 3/1914 | 40/597 |
| FR | 2650104 | * | 1/1991 | 40/593 |

* cited by examiner

*Primary Examiner*—Brian K. Green

(57) ABSTRACT

A durable lightweight rigid transparent envelope that is slightly curved in shape from top to bottom and attaches to automobile windows via suction cups in order to hold and display a variety of double-sided thin flexible lightweight message sheets, which are highly color-contrasted, light-reflective and contain large font character size messages in order to facilitate visual communication between automobile operators, passengers and pedestrians at distances normally encountered on streets and highways. A selected message can be displayed in the envelope through the envelope's transparent front side when it is attached to the inside of an automobile window, or a selected message can be displayed through the envelope's transparent back side while the envelope is attached to the outside of an automobile window by the same means. Indentations at the top of the envelope provide for quick and easy removal of message sheets by grasping them with the tip of a thumb and finger of the hand Small notches at the top of the envelope provide for the attachment of elastic bands in order to hold the message sheets in place inside the envelope when laying flat while not in use or being stored

1 Claim, 5 Drawing Sheets

AUTOMOBILE WINDOW MESSAGE DISPLAY DEVICE

CROSS REFERENCES TO RELATED APPLICATIONS

Patent applications for similar inventions were previously filed by this applicant on: Aug. 16, 1999 under patent application Ser. No. 09/374,939 known as "Car Note Sign" now abandoned; Feb. 28, 1998 under patent application Ser. No. 09/032,685 known as a "removable And Reversible Multiple Message Display Sign For Motor Vehicle Windows" now abandoned; and Oct. 13, 1998 under patent application Ser. No. 09/170,586 known as "Removable Multiple Message Display Sign For Motor Vehicle Windows" now abandoned. Subsequent to filing the three previous applications, each of which have since been abandoned, this applicant made several design modifications and improvements to the previous prototypes, as discussed below, which resulted in the new invention described in this new patent application.

(a) The envelope lid has been eliminated in order to provide quicker and easier insertion and removal of message sheets to and from the envelope.

(b) Vents have been added to the bottom of the envelope to promote drainage and evaporation of moisture that may accumulate from exposure to weather when mounted on the outside of an automobile window.

(c) A thumb and finger indentation has been added to the top center of each half of the envelope to facilitate the removal of message sheets from the envelope.

(d) Small notches have been added to each side of both halves of the envelope for the placement of elastic bands in order to hold the message sheets in place when the invention is laying flat while not in use.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to an automobile window message display device, which is comprised of a plastic envelope that is rectangular in shape, slightly curved from top to bottom, light in weight, rigid in flex, transparent, fully open at the top and partially vented at the bottom. The envelope holds, displays, protects and stores a wide variety of message sheets that are comprised of thin lightweight flexible material with light-reflective color contrasting messages and backgrounds. The envelope is attachable to the inside or outside of automobile windows by means of two suction cups for the purpose of visually communicating at night or day with people outside of the vehicle, such as drivers and passengers of other automobiles, as well as pedestrians.

The appropriate patent classification for my invention appears to be Class 40, CARD, PICTURE, OR SIGN EXHIBITING ("This class includes means for displaying information by printed or painted cards, calendars, photographic transparency viewers, railroad train station indicators, pictures, labels or tags or index files . . . ."), Subclass 584 SIGNS ("Device under the class definition which comprises inscribed boards, cards, slates, objects, etc., whereby definite information may be conveyed to an observer."), Subclass 597 ("Sign under subclass 584 wherein the sign is mounted with suction cups onto a surface.").

In spite of the proliferation of CB radios and cellular telephones in recent years, a significant number of operators and passengers of automobiles today do not have the use of either type of device to communicate with others as they travel on roads, streets, highways and freeways throughout the world. Also, present cellular telephone transmission and reception areas cover only a small percentage of existing roadways. Additionally, this type of telecommunication service is susceptible to disruption and interference from a variety of sources including, but not limited to, electromagnetic fields associated with high voltage electrical power lines and solar flare activity. Furthermore, inherent to automobile travel is a variety of other challenges and risks that, when confronted, beg for quick, simple and effective visual communication between drivers, passengers and pedestrians. Examples of such communication needs are warnings of hazardous road conditions and or vehicle collisions, requests for roadside assistance due to a vehicle breakdown or personal emergency situation, notification of vehicle malfunctions (headlight or taillight out, door or trunk ajar, low tire, etc.), as well as announcements, greetings, slogans, etc.

Because the need for this type of visual communication occurs under variable and oftimes challenging weather and lighting conditions, the ideal system and device would be one, in this applicant's opinion, that is effective, efficient, durable, practical, easy and safe to use, as well as reliable and affordable. To be effective, the sign must display messages from a prominent location either inside or outside of an automobile, and the message must be of sufficient size and format characteristics so as to render it easily visible and readable at distances typically encountered on roadways at night or day. To be efficient, the sign must allow the display of a wide variety and choice of messages, and yet be compact enough to fit most automobile passenger windows without over encumbering passenger space and comfort. To be durable, the device must be constucted of materials that can withstand a wide range of temperature and weather without compromise to its condition, operation and effectiveness. To be practical and easy to use, it must be lightweight, simple in design, with minimal components, and be easily and quickly attachable to and removable from an automobile window (whether flat, concave or convex) without damaging the surface, in addition to offering simple, easy and quick interchangeability of messages. To be safe, it must not interfere with the driver's view, as required by law, during his/her operation of the vehicle. To be reliable, it must be well designed and made of quality, long lasting materials. To be affordable, it must have a retail price of no more than the average cost to fill up a car's tank with gasoline.

It will be demonstrated in this application that the invention satisfies each of the above referenced requirements of the ideal device for visual communication between drivers and passengers of automobiles and pedestrians. Moreover, it will be shown that this invention represents significant improvements and advantages over, and exceeds the capabilities of, all prior related inventions of record.

2. Description of the Related Art Including Information Disclosed Under 37 CFR 1.97 and 1.98

Historically, operators of motor vehicles have relied on bumper and window stickers, in addition to individual placard type signs to communicate or advertise a thought, warning or other message to people outside of an automobile. A search of prior inventions did not identify any related devices that match all of the features, advantages and benefits of the invention. When compared to the ideal such device, of which the current invention is an example, all prior inventions to date suffer from significant disadvantages and shortcomings, as discussed below. U.S. Pat. No. 5,423,140 to Nuspl (1995) discloses a two-sided suction cup mounted sign for changeably displaying, via a scrolling device, identical indicia such as letters, or numbers on each side of the sign for the purpose of advertising the price of store goods and products. It was not intended for use in motor vehicle windows and is limited to the interchangeable display of three numeric characters only. U.S. Pat. No. 5,131,177 to Sy, Jr. (1992) discloses a portable and reversible lightweight sticker display apparatus for the purpose of displaying a variety of bumper stickers without adhering them directly to a surface and thereby eliminating damage to the surface and/or leaving adhesive residue. The use of this device is limited to the display of bumper stickers, the printed messages of which are quite small and are readable only at dangerously close proximity between vehicles. U.S. Pat. No. 5,062,380 to Chestnutt (1991) discloses a distress signal device for attachment to the outside of the side window of a motor vehicle for the purpose of signaling for help to passersby. It is limited to attachmnent to a side window, and it only affords a general distress communication limited to a color or a word, since it does not have the size capacity for more information or details regarding the nature of the call.

U.S. Pat. No. 4,953,315 to Romaine (1990) discloses a display device for automobiles and other vehicles for the display of messages for purposes of advertising, promotion, education or amusement. It is intended for placement in only the rear window of a motor vehicle, it is limited in its message capacity to one alternating line of characters, and the display of the entire two-stage message is dependant upon the movement of the vehicle to which the device is attached It doesn't work if the vehicle is standing still.

U.S. Pat. No. 2,143,608 to Morris (1939) discloses a frame designed for the purpose of holding a transparent panel via vacuum cups close to glass windshields and the like in order to eliminate frosting of the windshield in freezing weather conditions. It was not designed as a sign system, nor does it afford the displaying of messages.

U.S. Pat. No. 874,998 to Schumacher (1907) discloses a hanging reversible box type sign for automobiles for the purpose of displaying motor vehicle registration numbers and the abbreviation of the applicable state. It was not designed for, nor is it capable of being attached to motor vehicle windows. It must be hung from a hook or other attachment on or within a vehicle. In a size sufficient to afford the display of a multiple word message, the sign would take up too much room and therefore would be impractical for use in a motor vehicle.

U.S. Pat. No. 3,007,435 to Peterson (1961) discloses a motor vehicle window sign for the purpose of communicating highway traffic safety conditions between passing vehicles via color-coded placards. It is designed for attachment to the windshield with one suction cup. It is limited in size so as not to obstruct the driver's view of the road, and the messages are confined to the display of colors only, which represent certain coded information.

U.S. Pat. No. 1,739,801 to Pitts (1929) discloses an advertising device for attachment to any smooth surface via suction cups for the purpose of holding a supply of advertising circulars, cards or other materials to be made available for distribution to the public. It was not designed for the display of the messages held within, since it was to be made of a non-transparent material such as cardboard, nor was it intended for use in motor vehicles.

U.S. Pat. No. 3,237,330 to Dinstbir (1966) discloses a warning device for motor vehicles comprised of a message placard fitted into a suction cup base for attaching to the dashboard of a motor vehicle. It's small requisite size, so as not to interfere with the driver's view, significantly limits the message capacity. It is designed to mount on horizontal flat smooth surfaces only, and there is no holder on the device for extra message placards.

U.S. Pat. No. 4,055,012 to Cote (1977) discloses a sign system comprised of a housing, fabricated from a transparent material, containing a plurality of signs bearing safety warning and greeting indicia on the faces thereof, adapted to be carried in a motor vehicle. It is restricted to mounting to a window visor, glove compartment cove, door panel, or dashboard via double-sided adhesive tape. It is consequently restricted in size, which makes the messages difficult to read at reasonable distances, similar to the bumper sticker problem. Furthermore, it does not lend itself to the attachment to and/or quick removal from a window without the potential for damaging the window surface. As demonstrated by the above discussion of the disadvantages and shortcomings of the prior art, the invention offers many significant advantages, benefits and improvements over the existing related inventions, which is further articulated and demonstrated below.

BRIEF SUMMARY OF THE INVENTION

The objects of the invention meet all of the previously outlined requirements of the ideal visual communication device for automobiles and are summarized as follows:

(a) to provide an effective visual communication device for automobiles that can be prominently displayed on the inside or outside of an automobile window and is of sufficient size and format characteristics to be easily readable at distances typically encountered on and off the road at night or day, (b) to provide an efficient device that affords the display of a wide variety and choice of messages, while fitting most automobile passenger and rear windows without over encumbering passenger space and comfort, which can be attached to and displayed from inside or outside of the vehicle;

(c) to provide a durable device, the components of which are constructed in such a manner and of materials that can endure a wide range of temperatures (hot-cold) and weather without compromise to its condition, operation and effectiveness;

(d) to provide a practical and easy to use device made of lightweight materials, simple in design and construction, having a minimal number of easily assembled components that can be easily and quickly attached to and removed from an automobile window (whether flat, concave or convex) without damaging the surface thereof, and the messages of which are easily and quickly interchangeable;

(e) to provide a safe system, which does not interfere with the driver's view and operation of the vehicle as required by law;

(f) to provide a reliable device, which is well designed and constructed of quality long-lasting materials that afford dependable operation; and (g) to provide an affordable device, the cost of which falls within the budget of everyone who owns, leases or operates an automobile.

It will become evident to the reader of this patent application that the invention represents many improvements and advantages over prior inventions as identified below:

(1) The envelope affords the storage and display of a wide choice and variety of message sheets, including any foreign language, which allows the user to briefly identify and specify the exact nature of the topic he/she wishes to communicate to others.

(2) The message sheets are more visible and readable at greater distances than bumper stickers because of larger print size and high color contrasted characters and background through the use of highly light-reflective materials.

(3) The above described format also renders the messages highly visible under most weather and operating conditions on or off the road, during both daylight and nighttime hours, as well as when used inside of tinted automobile windows.

(4) The messages are printed on both sides of each message sheet in order to maximize efficiency by minimizing the space required inside and the weight of the envelope.

(5) The do-it-yourself message capability of the message sheets (utilizing blank sheets and self-adhesive characters) allows unlimited personalized and customized messages and communication.

(6) The envelope is quickly and easily attachable to and removable from the inside or outside of any window of an automobile (whether flat, concave or convex) by means of suction cups without damage to the window surface.

(7) The envelope is attachable to either the side passenger or rear window(s) of most automobiles for maximum visibility in order to: (a) minimize tailgating by other drivers who often try to get close enough to read small bumper sticker print; and (b) to avoid obstruction of the driver's view as required by law.

(8) The envelope holds multiple message sheets inside in reserve, making instant message sheet selection, removal and re-insertion possible. The thumb/finger indentations at the top of the envelope make this process easier and quicker.

(9) The envelope affords efficient organization, control, management, safekeeping and protection of the message sheets, whether during operation and use or stored in the trunk. When the envelope is not in use and lying flat, the message sheets are held in place by elastic bands attached to the envelope via notches on each side of the envelope top opening.

(10) The envelope is transparent, which allows the clear and unobstructed display and view of the message sheets through either side of the envelope, whether mounted on the inside or outside of an automobile window.

(11) The envelope is constructed of break and damage resistant materials, which promote longevity and dependable operation.

(12) The suction cups are of sufficient quality and size, in relation to the size and weight of the envelope with several message loaded therein, that they are capable of maintaining a constant suction grip on the window surface, regardless of slope, and thereby hold the envelope in place until intentionally removed.

(13) The envelope is slightly curved in shape from top to bottom in order to fit most, if not all, modern automobile windows, whether flat, concave or convex.

(14) The message sheet contrasting color combinations are similar to current highway sign color schemes for easy identification and recognition of message types; for example, messages with black or white letters on an orange light-reflective background designate road hazard information.

(15) The invention is easily transferable from vehicle to vehicle, and its transparent appearance is therefore compatible with any vehicle color scheme.

Although the above description contains many specifications, these should not be construed as limiting the scope of the invention but as merely providing illustrations of some of the presently preferred embodiments of this invention. For example, in addition to plastic, the envelope can be constructed of epoxy or other similar transparent lightweight rigid materials. The envelope may also contain a substance that causes it to glow in the dark, thereby illuminating, displaying and allowing the message sheets to be more legible at night. The means by which the envelope is manufactured and assembled can also be changed. The type, size and number of suction cups used can be modified. The dimensions, weight, shape, curvature and color characteristics of the envelope can be changed And, the material, number, dimensions, weight, format, color contrasting, light-reflectivity, font size and character style of the message sheets, printed messages and backgrounds can be varied. Suffice it to say that all components of the invention will be manufactured of materials possessing the characteristics that meet the utility requirements of the intended purpose of the invention according to specifications which will ensure optimal functioning and durability of each of the components under normal utilization in all weather conditions.

BRIEF DESCRIPTION OF THE SEVERAL VIEWS OF THE DRAWINGS

The invention is described in greater detail in the following description of an example embodying the best mode of invention, taken in conjunction with the drawing figures, in which.

Figure 1:
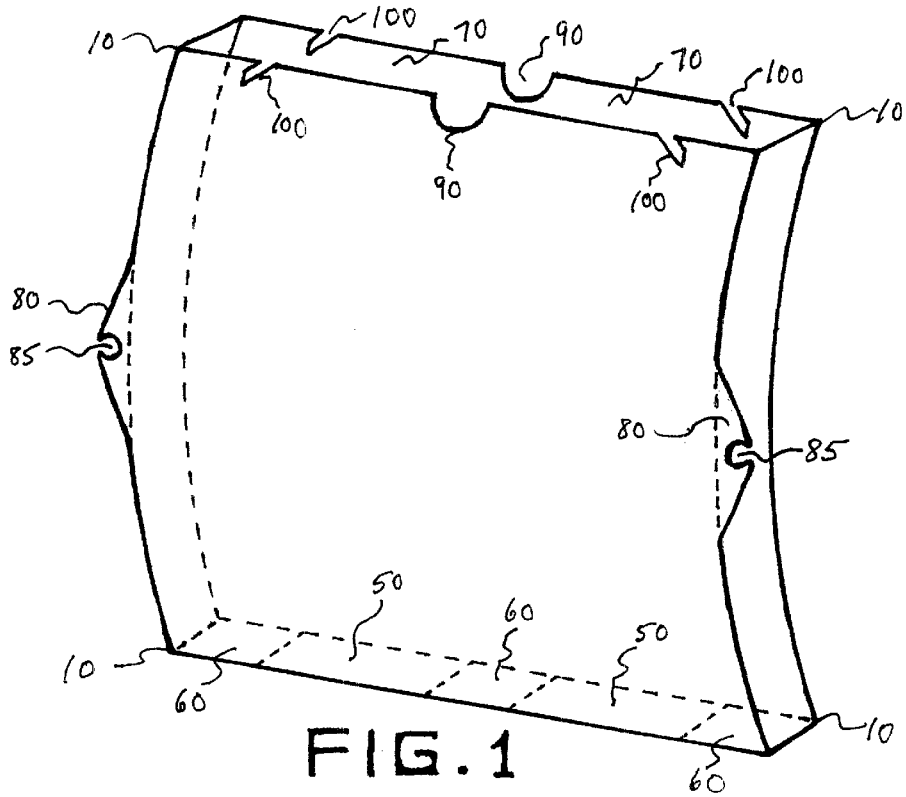
FIG. 1 is a three-dimensional frontal view of the envelope.

| Reference Numerals in Drawings | |
|---|---|
| 10 envelope | 20 front section |
| 30 back section | 40 side section |
| 50 partial bottom section | 60 bottom vent |
| 70 top opening | 80 suction cup holder |
| 85 suction cup fitting | 90 thumb/finger indentation |
| 100 elastic band notch | 105 elastic band |
| 110 suction cup | 120 double-sided message sheet |
| 130 message | 140 background |

DETAILED DESCRIPTION OF THE INVENTION

Figure 7:
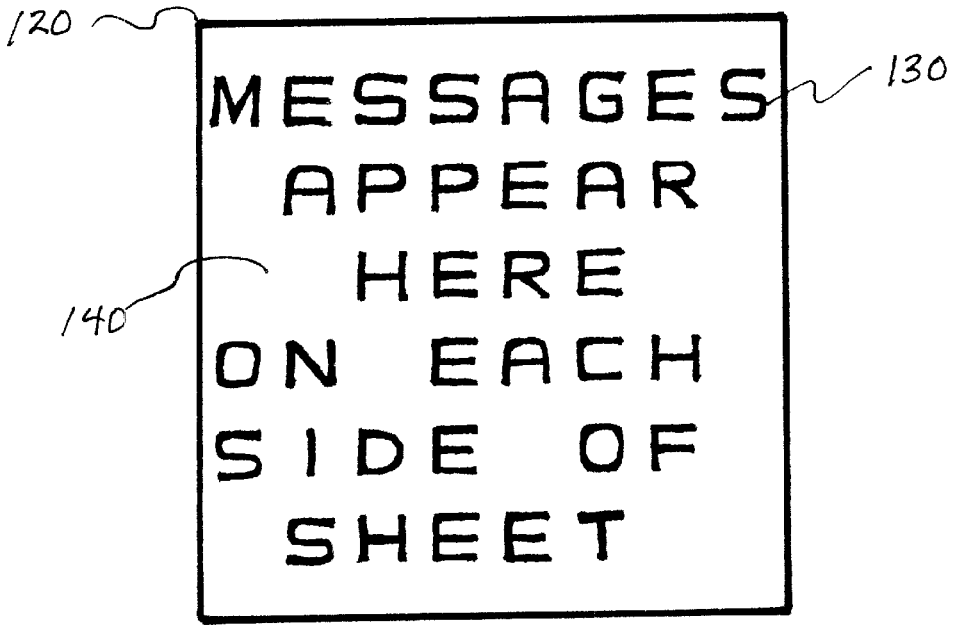
FIG. 7 is a frontal view of the message sheet.
Figure 8:
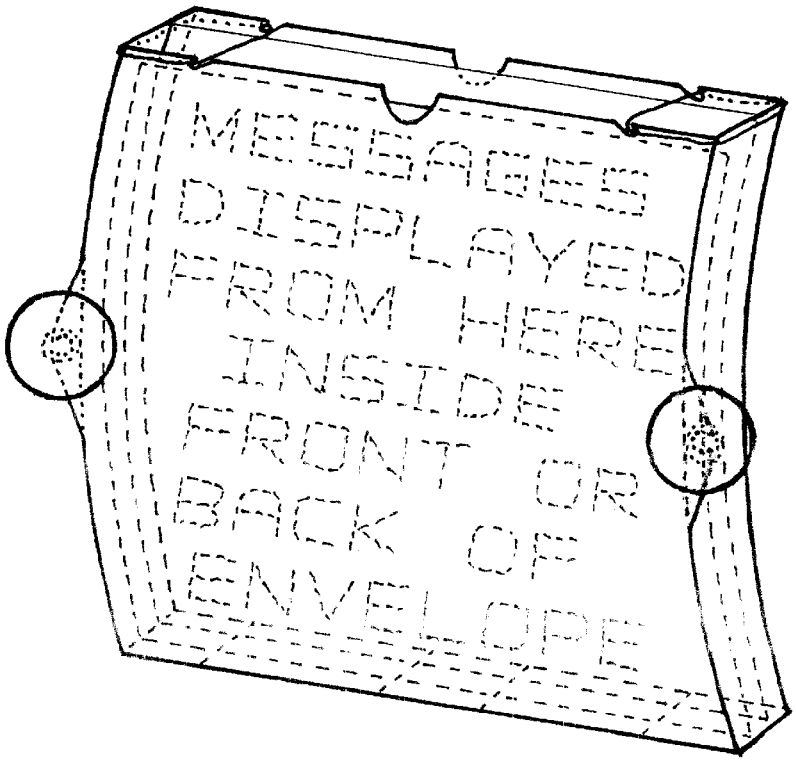
FIG. 8 is a three-dimensional frontal view of the fully assembled invention.

Referring to the drawings, FIGS. 1–12, a typical embodiment of the invention is illustrated in FIG. 8 and demonstrated in use on automobile windows in FIGS. 9–12. The invention is basically comprised of the following components: envelope 10, suction cups 110, elastic bands 105, and double-sided message sheets 120.

Figure 2:
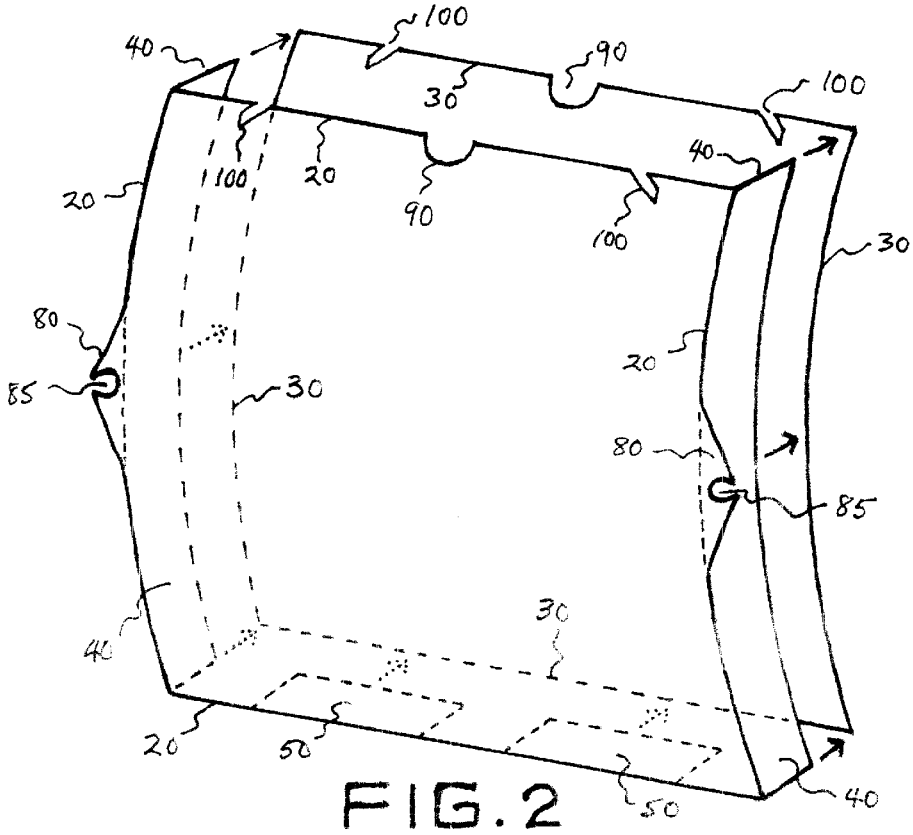
FIG. 2 is an exploded three-dimensional frontal view of the envelope front and back sections.

The envelope 10 will be manufactured of transparent lightweight rigid plastic or similar substance, made of one or more initial pieces, as shown in FIG. 2, through a pressed, injection molded, glue welded or similar process, which includes certain complementary improvements that facilitate the assembly and utilization of the invention for its intended purpose. The envelope 10 has a slightly curved shape from top to bottom, which is designed to facilitate the proper fitting of the envelope 10 to modem curved automobile windows. The top opening 70 and inside of the envelope 10 provide sufficient space to insert, hold and display one or more double-sided message sheets 120, as shown in FIGS. 1,8.

Figure 3:
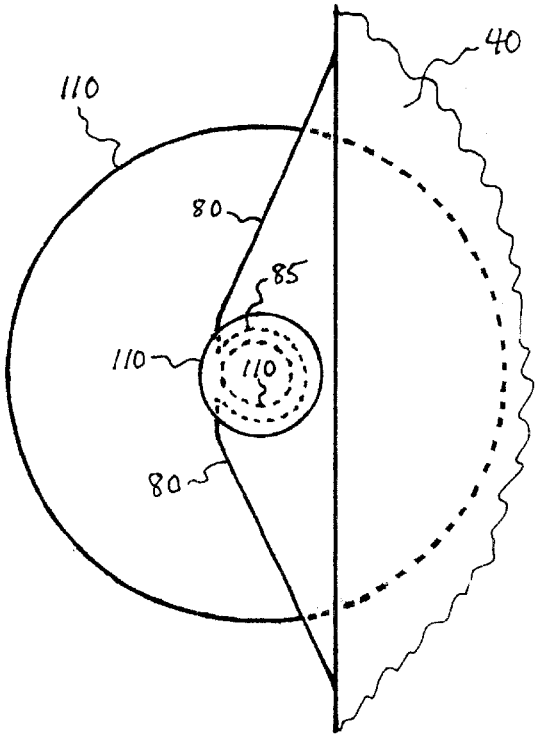
FIG. 3 is an enlarged rear view of the suction cup holder and fitting with the suction cup attached.
Figure 4:
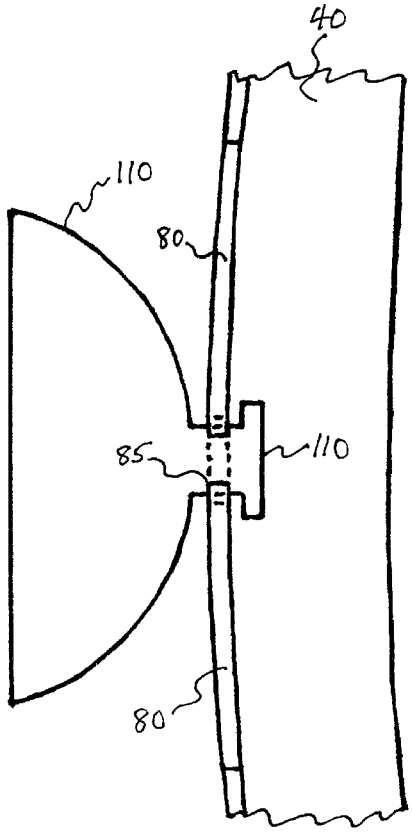
FIG. 4 is an enlarged side view of the suction cup holder and fitting with the suction cup attached.
Figure 5:
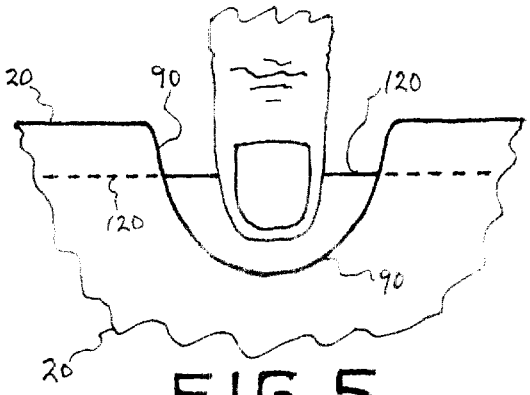
FIG. 5 is an enlarged frontal view of the thumb/finger indentation.
Figure 6:
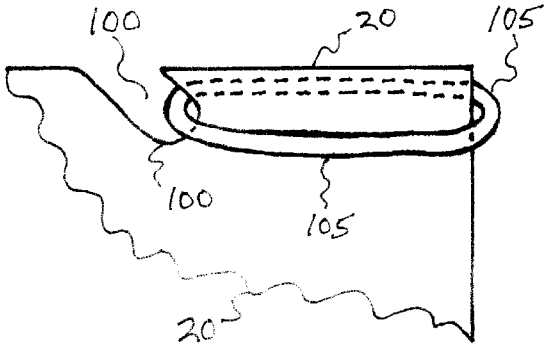
FIG. 6 is an enlarged frontal view of the elastic band notch.

Two suction cups 110 are attached to the envelope 10 by means of the suction cup holders 80 and suction cup fittings 85 located at the side front center edges of the envelope front section 20, as illustrated in FIGS. 1–4. Each suction cup 110 is attached by manually pressing the shaft of the suction cup 110 into the suction cup fitting 85 until it snaps firmly into place as shown in FIGS. 3,4. Once thusly assembled, the envelope 10 can be attached to a window or similar surface by grasping the envelope 10 from the envelope back half 30 with one hand on each side next to a suction cup holder 80 and then pressing the mouth of each suction cup 110 against the window until each suction cup 110 seals and adheres firmly to the attached surface. To detach each suction cup 110, as well as the envelope 10, from the window, manually break the seal of each suction cup 110 by lifting the edge of the mouth of each suction cup 110 away from the attached surface with a finger of each hand and then pulling each suction cup 110 along with the envelope 10 away from the surface until fully detached The double-sided message sheet 120, as shown in FIG. 7, is constructed of a thin flexible sheet of material that is most likely comprised of paper, cloth, plastic or other similar substance that is water and tear resistant, and which is rectangular in shape and concentric with, but slightly smaller in dimension than, the envelope top opening 70 and inside of the envelope 10, in order to easily and properly fit through the top opening 70 as well as within the envelope 10 as shown in FIG. 8. The message sheet background 140 consists of a highly light-reflective colored surface, which is in contrast with the large font bold characters (either light-reflective or non-light-reflective) of the message 130. For example, double-sided message sheets containing messages regarding road hazard warnings might consist of light-reflective white characters on a light-reflective orange background; requests for roadside assistance message sheets might consist of light-reflective white characters on a red light-reflective background; vehicle malfunction notice messages might consist of white light-reflective characters on a green light-reflective background; greeting messages might consist of white light-reflective characters on a blue light-reflective background; and, do-it-yourself messages might consist of non-light-reflective black self adhesive characters on a white light-reflective background or similar combination. Each double-sided message sheet 120 can accommodate a different message 130 on each side, which minimizes the size and weight of the envelope and increases the efficiency of the invention by allowing several message sheets to be stored in reserve within the envelope while others are being displayed.

A thumb/finger indentation 90 is located at the top center of each of the envelope front and back sections 20,30 in order to facilitate the grasping and removal of double-sided message sheets 120 from the envelope 10 through the narrow envelope top opening 70, as shown in FIGS. 1,2,5,8.

The double-sided message sheets 120 can be held in place within the envelope 10, while not in use laying flat or being stored, by means of attaching one or two elastic bands 105 to the top of the envelope via the elastic band notches 100 located on the top edge of the envelope front and back sections 20,30 near each envelope side section 40, as shown in FIGS. 1,2,6,8. When the invention is in use in an upright position attached to a window, the elastic band holding method is usually not necessary since gravity keeps the message sheets securely in place within the envelope.

Figure 9:
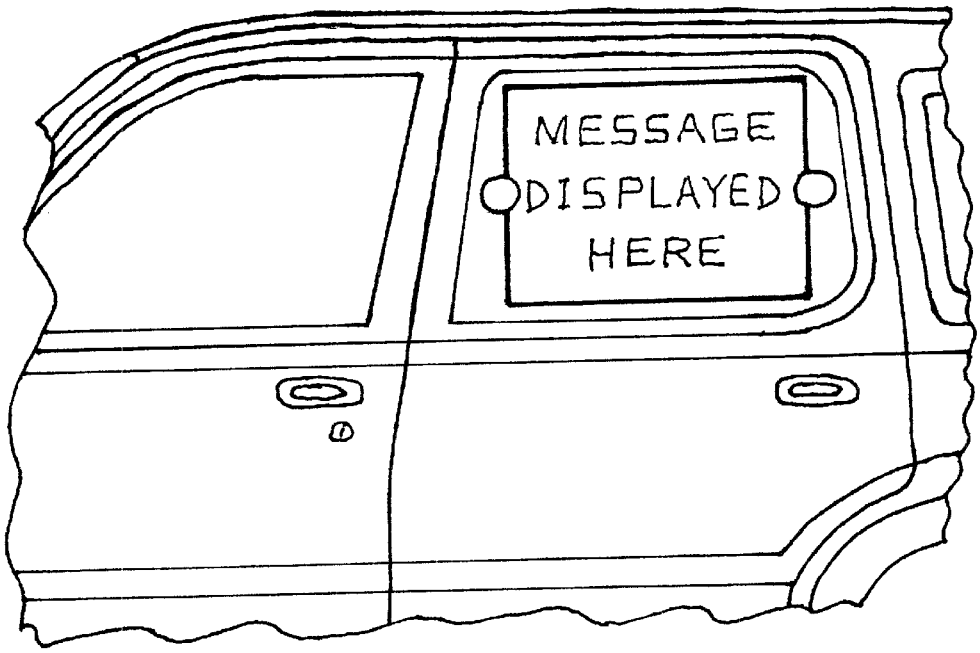
FIG. 9 is a reduced partial left side view of an automobile showing the invention attached via suction cups to the inside of and displayed through the rear left passenger window.
Figure 10:
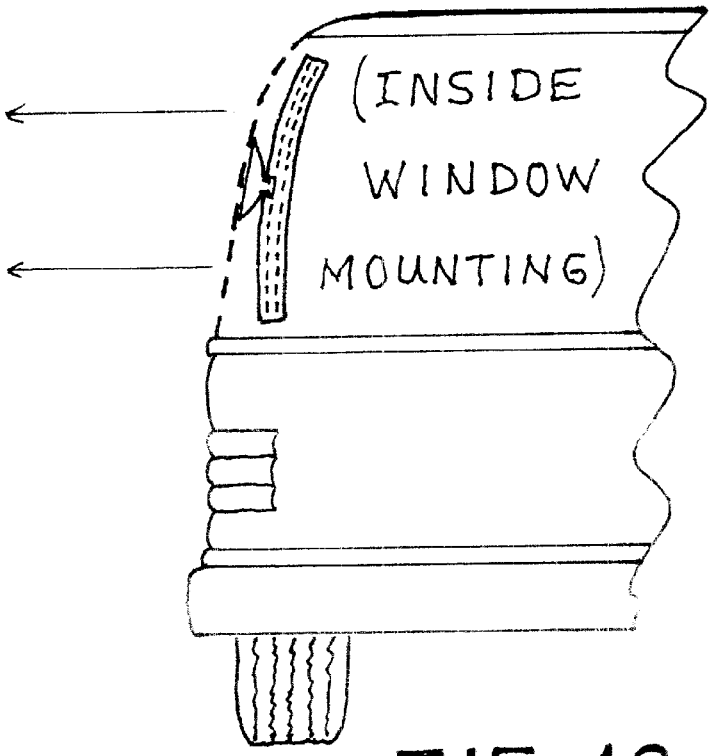
FIG. 10 is a reduced partial cross-sectional left side rear view of an automobile showing the method of attachment and display of the invention from the inside of the rear left passenger window.
Figure 11:
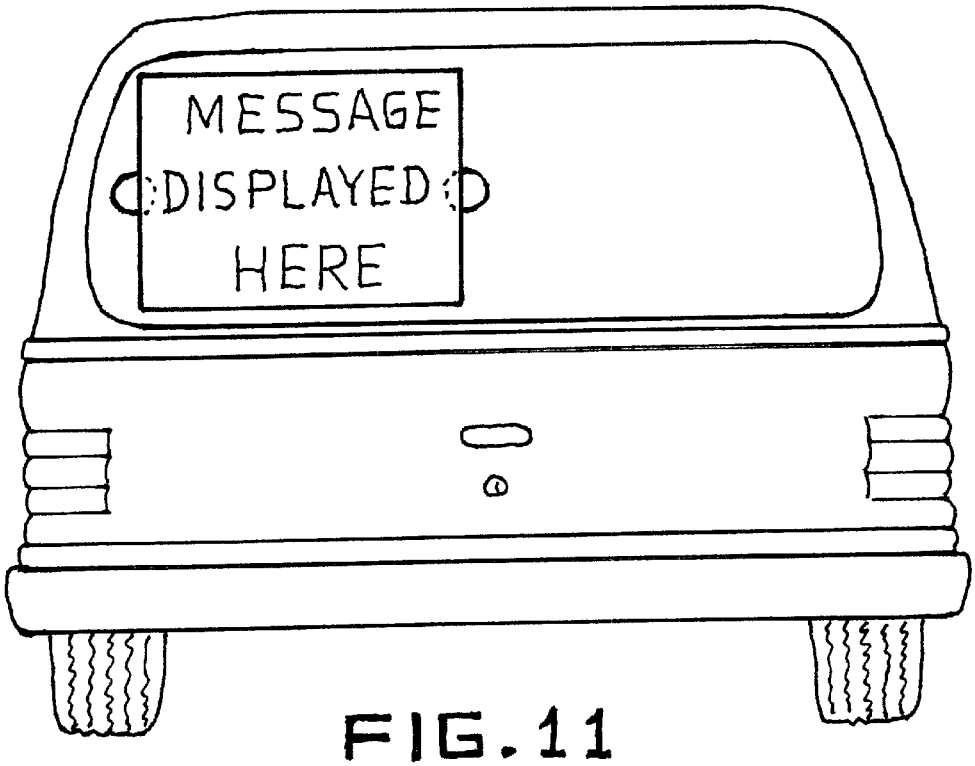
FIG. 11 is a reduced rear view of an automobile showing the invention attached via suction cups to and displayed from the outside of the rear window.
Figure 12:
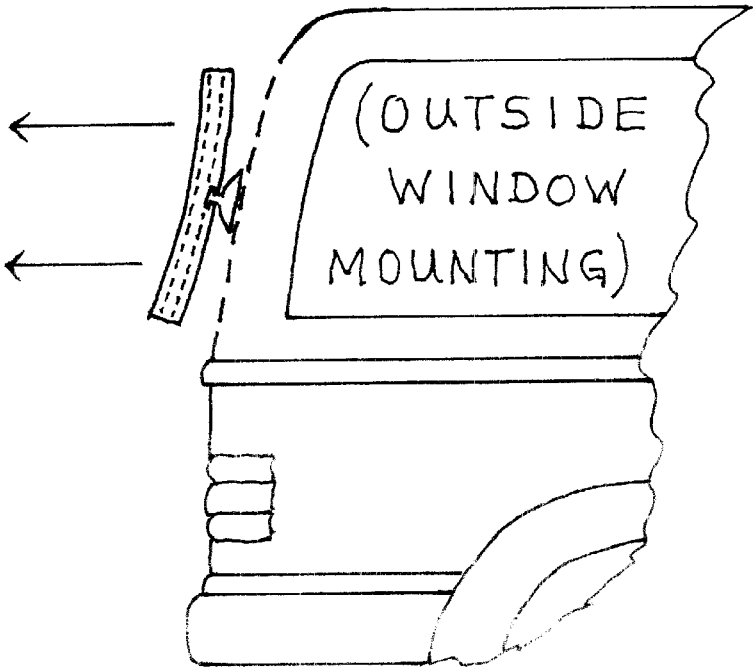
FIG. 12 is a reduced partial cross-sectional rear right side view of an automobile window showing the method of attachment and display of the invention from the outside of the rear window.

As has been demonstrated thus far, the versatility of the invention allows the display of message sheets from the inside or the outside of an automobile window. The typical manner in which the invention is utilized is described as follows. After selecting a message to be displayed from the inside of an automobile window, the appropriate side of the double-sided message sheet is placed inside of and next to the front of the envelope with the chosen message facing outward for the clear unobstructed display of the message through the front of the envelope. The envelope is then attached to the inside of one of the rear side passenger windows or rear window of an automobile in the prescribed manner, as shown in FIGS. 9,10. If a change of message is required, one or more message sheets are grasped and removed by hand from the envelope, after which a new message selection is made, and the chosen message sheet is then placed next to and inside of the front of the envelope with the new message facing outward for proper display. It is not always necessary to detach the envelope from the window in order to make such a change because of the easy accessibility of the message sheets through the open top of the envelope. For use on the outside of an automobile window, which affords even greater visibility when the vehicle is stopped, stranded on the roadside or the windows are tinted, simply place the selected message sheet inside of the envelope with the chosen message facing the back side of the envelope, and then attach the front of the envelope by way of the suction cups to the outside of the selected window, which will then allow the chosen message to be clearly displayed through the back of the envelope, as shown in FIGS. 11,12. While displayed on the outside of the vehicle, the message sheets are protected from potential disruption and damage from wind and weather by the design and durable weather-resistant features of the envelope. Furthermore, the use of the invention is not limited to automobiles, as it can be easily used on any window or polished non-porous surface, which is compatible with the suction cup method of attachment, for the display of a wide variety of messages and information.

While various embodiments of the invention have been shown, it is understood that one skilled in the art may realize other embodiments. Various changes can be made to the invention without departing from the spirit or scope thereof.

I claim:

1. A transparent envelope comprising:

(a) a front section, a back section, side sections, and a bottom section, a top of the envelope including an opening for allowing a double-sided message sheet to be slid into the envelope;

(b) the envelope having a curved shape from top to bottom;

(c) suction cups attached to opposite edges of the envelope;

(d) an indentation located at a top edge of each of the front and back sections for facilitating grasping and removal of the double-sided message sheet;

(e) at least one notch in the top edge of each of the front and back sections;

(f) and an elastic band passing through the at least one notch in each of the front and back sections for securing the band to the envelope and for covering a portion of the opening of the envelope for preventing the double-sided message sheet from falling out of the envelope.

* * * * *